United States Patent [19]

Watts et al.

[11] 4,199,085

[45] Apr. 22, 1980

[54] SLIDING GATE VALVE

[75] Inventors: Norman H. Watts, Sheffield; Philip Weatherall, Staveley; Robert D. Hind, Rotherham, all of England

[73] Assignee: USS Engineers & Consultants, Inc., Pittsburgh, Pa.

[21] Appl. No.: 876,964

[22] Filed: Feb. 13, 1978

[30] Foreign Application Priority Data

Feb. 17, 1977 [GB] United Kingdom ..... 6612/77

[51] Int. Cl.[2] ..... B22D 41/08

[52] U.S. Cl. ..... 222/600; 222/512; 251/193; 251/174

[58] Field of Search ..... 251/174, 176, 193; 222/561, 512, 504, 598, 600

[56] References Cited

U.S. PATENT DOCUMENTS

| | | | |
|---|---|---|---|
| 506,328 | 10/1893 | Morris | 222/561 X |
| 4,063,668 | 12/1977 | Shapland et al. | 222/600 X |
| 4,076,153 | 2/1978 | Tinnes | 222/600 |

*Primary Examiner*—David A. Scherbel
*Attorney, Agent, or Firm*—John F. Carney

[57] ABSTRACT

A slide gate valve for use with a molten metal teeming vessel is provided with elongated resilient supports that may be in the form of leaf springs, or the like, and are operative to resiliently bias the slide plate of the valve against the head plate thereof. The resilient supports are releasably secured to the vessel by linkages that facilitate disassembly of the valve elements for servicing.

11 Claims, 8 Drawing Figures

SLIDING GATE VALVE

Figure 1:
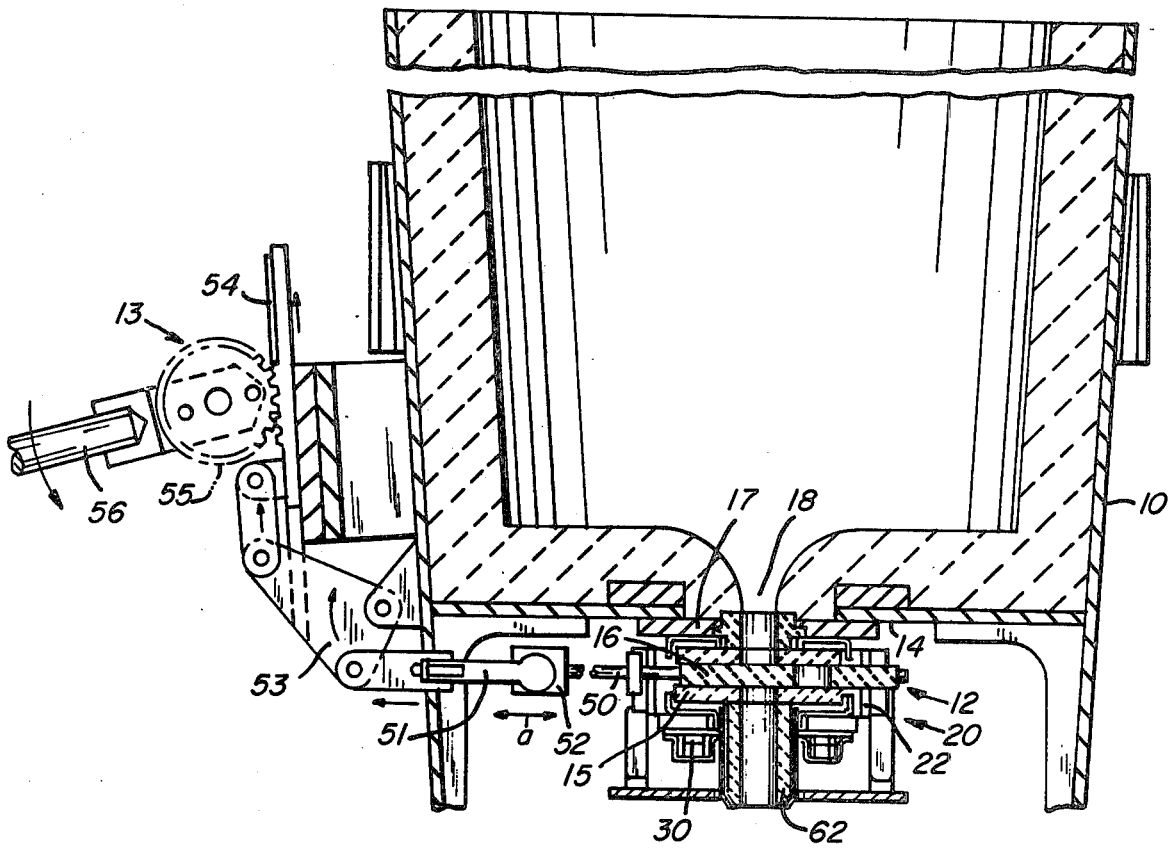

The present invention relates to improvements in or concerning slide gate valves for use in controlling the teeming of molten metals such as steels. Slide gate valves to which the invention relates can be fitted to such vessels as ladles or tundishes.

According to one aspect of the present invention there is provided a slide gate valve comprising a mounting plate for attaching the valve to a vessel for molten metal, a stationary orificed refractory plate located by the mounting plate, and an assembly secured to the latter and including a slide carriage mounting an orificed refractory slide plate for sliding movement in contact with the underside of the head plate, a plurality of elongated spring support members being secured to the mounting plate and disposed to engage the assembly for resiliently biasing the assembly towards the mounting plate thereby to urge the slide plate into firm sliding contact with the head plate.

The invention is applicable to valves having two or three or more orificed refractory plates.

According to another aspect of the invention, there is provided a slide gate valve comprising a mounting plate for attaching the valve to a vessel for molten metal, a plurality of orificed refractory valve plates a first of which constitutes a head plate located by the mounting plate, second and third orificed plates forming part of an assembly including a slide carriage, the second orificed plate forming a stationary element of the assembly, and the third orificed plate being carried by the slide carriage for movement therewith so as to constitute a slide plate which is sandwiched between the first and second orificed plates, a plurality of elongated spring support members being secured to the mounting plate and disposed to engage the assembly for resiliently biasing the assembly towards the mounting plate thereby to urge into firm sliding contact with one another the said second and third plates, and the said third and first plates.

To minimise untoward heating of the spring support members, which could have the effect of reducing the biasing exerted thereby on the assembly, it is preferred to locate the said members beneath the assembly; it is moreover preferred to protect the said members from radiation by a heat shield. A desirably simple construction also results from so locating the said members. Means can be provided to create a flow of cooling air over the said members, if desired.

The spring support members can comprise rigid elongated bearers and one or more spring elements, the latter for example being sandwiched between the bearers and the assembly. Such spring elements can comprise inter alia coil springs, disc springs and gas-filled springs, or a mixture of these types of springs.

Preferably, however, the spring support members are themselves resilient spring elements. They can be, for instance, resiliently flexible beams or leaf springs.

Advantageously, the said assembly is fastened to the mounting plate by means of linkages by which the spring support members are themselves attached to the mounting plate, the linkages being releasable to enable the said assembly and the spring support members to be displaced away from the mounting plate when servicing of the valve becomes necessary.

In a preferred embodiment of the invention, the said linkages are toggle joints each having one end pivoted to the mounting plate and the other end attached to an end of one of the spring support members. In this embodiment, the spring support members are held captive to the assembly and form the only connections between the assembly and the linkages fastened to the mounting plate. When the toggle joints are manipulated to overcentre them, the arrangement is such as to draw the spring support members and hence the assembly bodily towards the mounting plate to a position in which the spring support members are effective to bias the refractory plates into firm sliding contact with one another.

The spring support members can have hooks at one or both of their respective ends to permit the members to be disengaged from the linkages.

To avoid any risk of the valve components being distorted upon manipulating the linkages to release or fasten the assembly in its operative position, the linkages are desirably simultaneously manipulated. Where two spring support members are employed, as is preferred, there are two pairs of linkages, and the linkages of each pair are coupled together so as to be simultaneously manipulatable. Mechanical, pneumatic, hydraulic or electro-magnetic actuators are desirably provided for manipulating the two pairs of linkages simultaneously.

In a preferred embodiment having two spring support elements, these can be arranged to extend transversely with respect to the path of movement of the slide plate. Since the latter in a two-plate valve may have a discharge or collector nozzle projecting therefrom, the spring support members should be spaced apart sufficiently to allow adequate unimpeded to and fro movement of the slide plate and nozzle for proper opening and closing of the valve.

The invention comprehends a vessel such as a ladle or tundish when fitted with a slide gate valve according to the invention.

Figure 2:
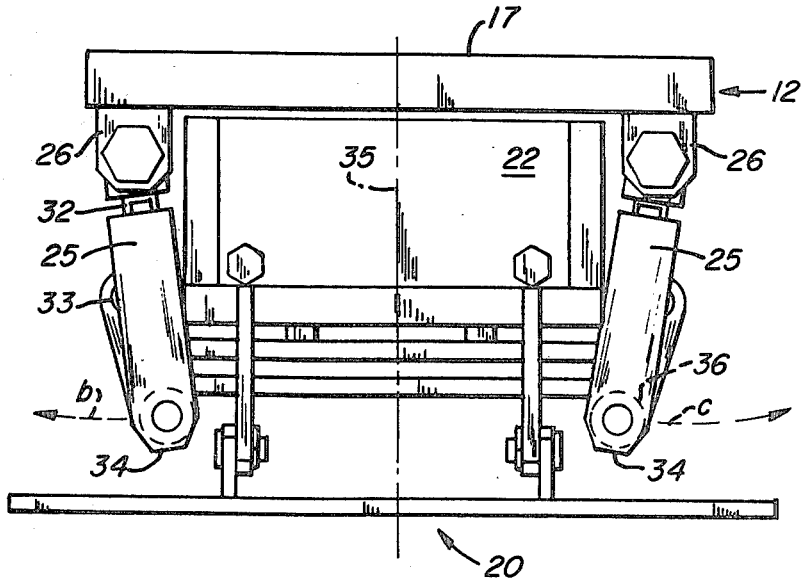
Figure 3:
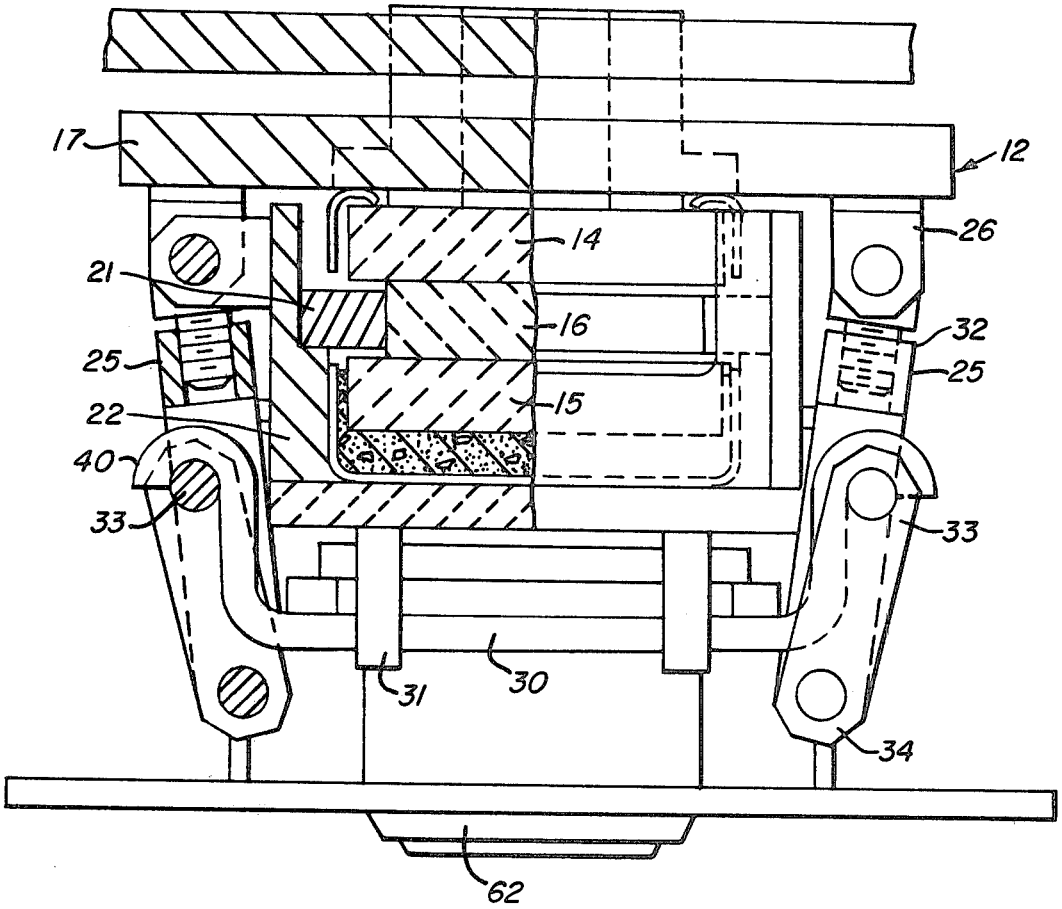
Figure 4:
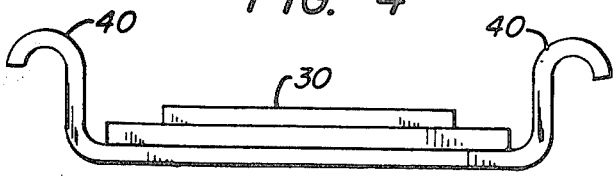
Figure 5:
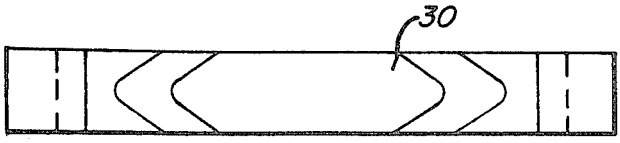
Figure 6:
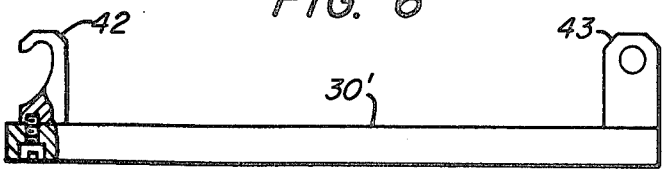
Figure 7:
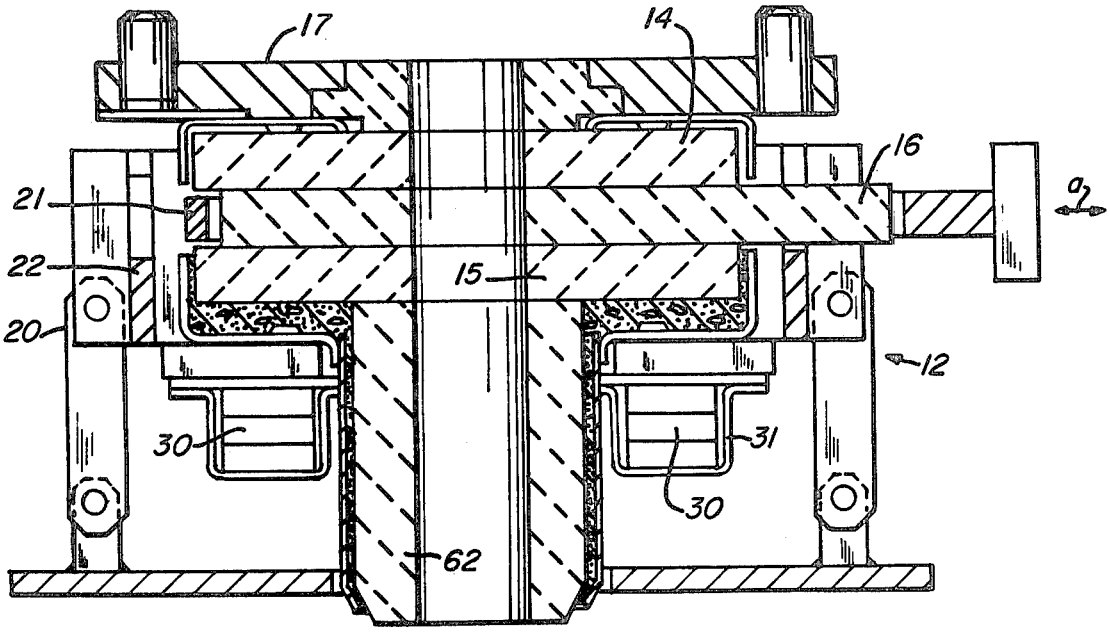
Figure 8:
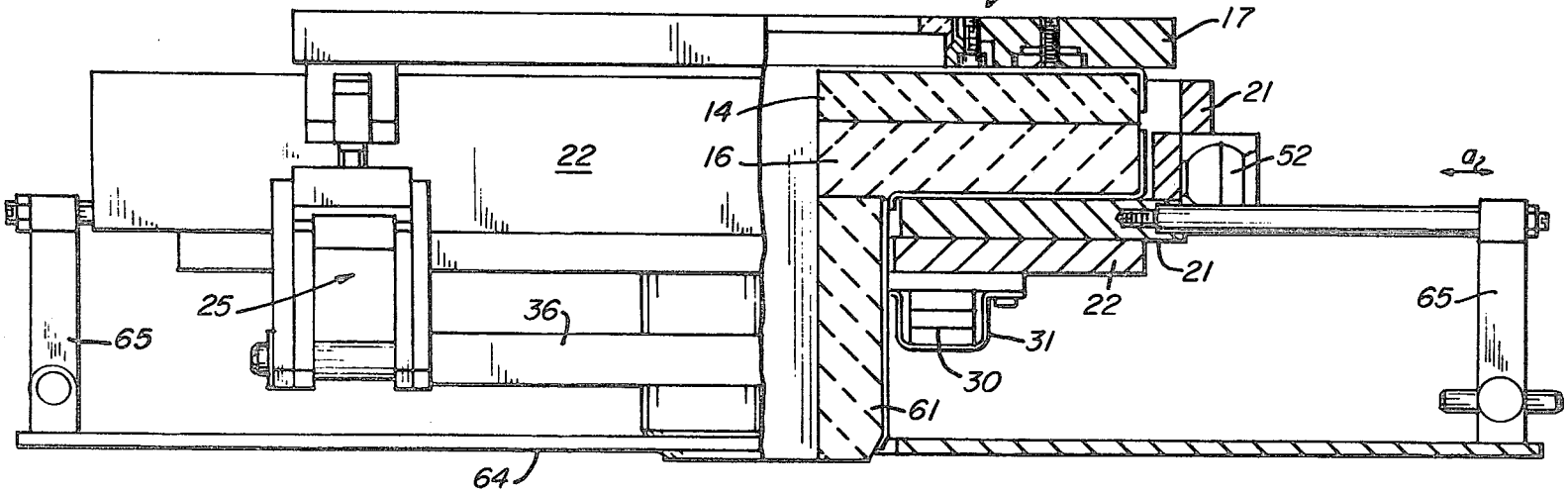

Preferred embodiments of the present invention will now be described in more detail by way of example only with reference to the accompanying drawings, in which:

FIG. 1 is a cross-sectional view through a ladle to which is fitted a three-plate slide gate valve according to the invention, FIG. 2 is an enlarged side elevational view of the valve shown in FIG. 1, when seen from the right in FIG. 1, FIG. 3 is an enlarged, part-sectional and part elevational view of the valve seen in FIG. 1, FIG. 3 being taken at right angles to the showing of FIG. 1, FIGS. 4 and 5 are respectively side elevational and plan views of a first spring support element, FIG. 6 is an elevational, part-sectioned view of a second spring support element, FIG. 7 is another cross-sectional view through the valve similar to the showing of FIG. 1, FIGS. 1 and 7 being sections as viewed in mutually opposite directions, and FIG. 8 is a part-sectioned, part elevational view of a two-plate slide gate valve according to the present invention.

In FIG. 1 of the drawings is illustrated a vessel for molten metal, the vessel comprising a generally conventional bottom pour ladle 10 to which is fitted a slide gate valve 12. Features of the valve will be more clearly seen in the enlarged illustrations of FIGS. 2, 3 and 7. The parts of the valve 12 are shown arranged in FIG. 1 for valve closure preventing flow of metal from the ladle 10, and in FIG. 7 for fully opening the valve to metal flow. By suitably operating a valve actuator 13, it is possible to open the valve only partly for metering metal flow therethrough.

With the exception of the valve shown in FIG. 8, to be described hereinafter, the valve 12 presently under consideration is a three-plate valve, that is it has three orificed refractory plates 14, 15 and 16 held in face-to-face contact. The two orifices in the first and second plates 14 and 15, which are stationarily mounted in the valve, are aligned. The third plate 16 is sanwiched between the first and second plates 14, 15 and its orifice can be brought into and out of registry with the said two aligned orifices, to open and close the valve, by to and fro sliding movement of the third plate 16 relative to the stationary plates 14, 15. Movement of plate 16 is accomplished by operating the actuator 13.

In each of the valves illustrated in FIGS. 1 and 8, it can be arranged that movement of the slidable plate to either side of a central valve-open position thereof accomplishes valve closure.

The valve 12 is secured to the bottom of the ladle 10 by a valve mounting plate 17, the plate 17 serving to locate the first stationary or head plate 14 with its orifice maintained in alignment with a pour opening 18 of the ladle 10. Suspended from mounting plate 17 is an assembly 20 of valve parts including the second and third plates 15, 16 and a slide carriage 21 in which the third or slide plate is seated. The slide carriage 21 is linearly reciprocally movable in a slide frame 22 in which the second or bottom plate 15 is seated. The direction of movement of the carriage 20 and slide plate 16 is indicated in the drawings by the arrow a.

The said assembly 20 is suspended from the mounting plate 17 by releasable linkages 25 pivotally connected to depending lugs 26 on the mounting plate 17. Connection between the linkages 25 and the assembly is by way of elongated spring support members 30 that are held captive to the underside of the slide frame 22 by straps 31. The arrangement is such that in an operative condition of the linkages 25, the spring support members are under load and are caused resiliently to urge the assembly 20 upwardly towards the mounting plate 17. In a released condition, the linkages allow the assembly to drop away from the mounting plate 17 to allow the valve to be serviced and worn refractory parts to be replaced. In the embodiment being considered, it is possible either to detach the assembly 20 completely from the mounting plate or to swing it downwardly about a hinge axis along one edge of the assembly. In each of the accompanying Figures illustrating the valve, the linkages 25 are shown in their operative conditions.

The linkages 25 comprise toggle joints each having one end 32 pivoted to one of the lugs 26 and its other end 33 pivotally coupled to an end of one of the spring support members 30. Upon manipulating the toggle joints from their released condition to over-centre them in their operative conditions, the toggle joints push the spring support members 30 upwards and cause the members 30 to bias the assembly 20 upwardly towards the mounting plate 17. The necessary manipulation of the toggle joints to the operative condition is illustrated by the arrows b and c in FIG. 2. As indicated, it is necessary to draw the intermediate pivots or knees 34 of the toggle joints outwardly to reach the operative condition thereof.

The present embodiment utilises two spring support members 30 each of which spans and abuts the underside of the slide frame 22. Each member 30 is coupled to the ends 33 of two joints. There are thus two pairs of toggle joints, one pair disposed to the left and one pair to the right of a central vertical plane 35 through the valve, see FIG. 2. The toggle joints of each pair thereof are interconnected by a bar 36 to which the knees 34 of the joints are pivoted. It will be appreciated that the two joints of each pair thereof are manipulatable simultaneously by appropriately pushing or pulling on the bars 36.

In order to avoid subjecting the valve to uneven loading upon manipulating the toggle joints, it is desirable to arrange that both pairs thereof are manipulatable in exact unison. Mechanical, pneumatic, hydraulic or electro-magnetic actuators may be employed for effecting simultaneous movements of the bars 36 interconnecting the joints.

One preferred form of spring support member 30 is shown in FIGS. 4 and 5. Member 30 comprises a multi-part leaf spring having hooks 40 at each of its ends. The hooks are intended to rest on pivot pins at the ends 33 of two of the toggle joints, see for instance FIG. 3. With such a leaf spring, upon manipulation of the toggle joints to their released condition, it is possible to unhook the leaf spring from its associated joints to enable the assembly 20 to be separated entirely from the mounting plate.

An alternative spring support member 30′ is shown in FIG. 6. Member 30′ is a resiliently flexible spring beam having a hook 42 at one end and an eye 43 at its opposite end. Eye 43 is intended to be assembled permanently or semi-permanently to the pivot at the end 33 of a toggle joint. With this arrangement, it is possible upon manipulating the toggle joints to their released condition to detach the hooked end of the beam 30′ from one toggle joint and then to swing the beam 30′ downwardly about its other end. In this way, the assembly 20 can be hinged downwardly about a hinge axis extending along one of its edges between the aligned eyes 43 of the two beams 30′, the assembly 20 remaining coupled to the mounting plate 17 so long as the two eyes 43 are kept assembled to the pivots of the associated toggle joints.

If desired, the leaf spring member could have an eye at one end in place of one of the illustrated hooks 40, and the beam spring 30′ could have two hooks 42.

The actuator 13 shown in FIG. 1 comprises a pair of push/pull rods 50,51 which are coupled together by a ball joint 52. Rod 50 is secured to the slide carriage 21 and rod 51 is secured to a bell crank 53 pivoted to the ladle 10. The bell crank is also linked to a toothed rack 54 movably mounted to the ladle 10. A pinion gear 55 fast with a lever 56 meshes with the rack 54. It will be understood that upon swinging the lever 56 up or down, the slide plate 16 is caused to reciprocate slidingly between valve closed and valve open positions. The lever 56 can be operated manually. Instead of the manually-operable actuating mechanism just described, it will be recognised that other actuating means such as a hydraulic or pneumatic actuator or an electric actuator could be coupled to the push/pull rods 50,51 to drive the slide plate 16 to and fro.

The slide gate valve 60 shown in FIG. 8 is in most respects identical to the valve already described. Reference numerals already used hereinbefore are employed in FIG. 8 to denote corresponding parts of the valve 60. Valve 60 is a two plate valve having only two orificed refractory plates, namely a stationary head plate 14 and a movable slide plate 16.

In valve 60, the slide plate 16 has a depending pouring nozzle 61 which is movable with the slide plate. The spring support members 30—of which there are two—extend transversely to the direction of movement of the slide plate 16 and the nozzle 61. The distance between the members 30 parallel to the said direction of movement is sufficiently large to allow adequate unimpeded movement of the slide plate and nozzle between valve closed and valve opened positions.

It will be realised that when the valve 60 is adjusted in use, movement of the slide plate 16 and nozzle 61 will be accompanied by some lateral movement of a jet of molten steel issuing from the valve. In many cases such displacement of the jet is tolerable, but if it is necessary to avoid displacement of the jet e.g. when teeming in a billet casting plant or into a small mould or trumpet, the valve 12 shown in FIGS. 1 to 3 and 7 may be preferred. Substantially no displacement of the jet occurs with this valve, because the nozzle 62 thereof remains stationary with the stationary plate 15.

In the illustrated valves, the spring support members 30 are favourably located, from the thermal point of view, beneath the slide frame 22. Such positioning of the members 30 minimises untoward heating thereof. Further to minimise heating of the members 30 and other parts of the valve, by convective and radiant heat from molten metal in a receiver vessel below the valve, each valve is fitted with a heat shield 64. Shield 64 is hung from the slide frame 22 by suspensions 65.

If desired, the nozzles 61,62 can be of extended lengths or can be fitted with extension pieces to help produce a well-defined jet of molten metal, or to enable submerged pouring to be carried out. The use of extended nozzles or nozzle tips with restricted orifices is particularly beneficial when throttling to produce a compact jet of molten metal.

Further, if desired, means can be provided for conducting gases such as argon to the metal flow passages through the valves or to the points at which metal issues therefrom. Gas admission can be helpful, especially when pouring deoxidised steels such as Al-killed steels to minimise nozzle erosion or blockage, and also to produce a smooth or well-defined metal jet. Equipment for admitting gas is disclosed in U.S. Pat. Nos. 4,003,561 and 4,131,219.

It will be appreciated that valves embodying the invention may be modified by the provision of two or more teeming orifices in their slidable plates. If said orifices have differing sizes, the teeming operator can select a teeming orifice best suited to the ferrostatic head in the vessel and the teeming rate required. Moreover, the provision of two or more such orifices enables the operator to change to a fresh orifice should deposits accumulate during the teeming of e.g. Al-killed steels.

What is claimed is:

1. Slide gate valve apparatus for use with a molten metal teeming vessel comprising:

(a) a stationary refractory head plate containing an orifice defining a pour opening from said vessel;

(b) assembly means including a stationary carrier supporting an orificed refractory slide plate for sliding movement in contact with the facing surface of said head plate; and (c) means for suspending said assembly means from said vessel including:

(i) elongated resilient support means extending transversely of the underside of, and vertically supporting said carrier; and (ii) releasable linkage means connecting said support means with respect to said vessel and being operative, when actuated to a closed position, to impart an upward force to said support means against said carrier for resiliently biasing said slide plate into firm sliding contact with said head plate.

2. The apparatus as recited in claim 1 in which said assembly means includes a stationary refractory plate containing an orifice vertically aligned with said head plate orifice, said stationary plate cooperating with said head plate to engage said slide plate in sandwiched relation.

3. The apparatus as recited in claim 1 including a heat shield disposed outwardly of said spring support means for protecting the same against overheating.

4. The apparatus as recited in claim 1 in which said spring support means comprise rigid elongated bearers and one or more spring elements mounted thereon.

5. The apparatus as recited in claim 1 in which said spring support means comprise resilient spring elements.

6. The apparatus as recited in claim 5 in which each spring element includes a flexible beam.

7. The apparatus as recited in claim 5 in which each spring element includes a leaf spring.

8. The apparatus as recited in claim 1 in which said linkage means comprise toggle joints each having one end pivotally connected to said vessel and the other end attached to said spring support means.

9. The apparatus as recited in claim 8 in which said linkage means comprise opposed pairs of toggle joints, spring support means extending between and engaging the toggle joints of each pair, and means for simultaneously manipulating the pairs of toggle joints.

10. The apparatus as recited in claim 1 in which said spring support members are captively attached to said assembly means and including means for connecting the ends of said spring support members to said linkage means.

11. The apparatus as recited in claim 10 in which said connecting means comprise releasable hooks engagable with said linkage means.

* * * * *